US006682303B2

(12) United States Patent
Wu

(10) Patent No.: US 6,682,303 B2
(45) Date of Patent: Jan. 27, 2004

(54) DO-IT-YOURSELF CEILING FAN WITH CEILING LAMP

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 12 days.

(21) Appl. No.: 10/158,444

(22) Filed: May 31, 2002

(65) Prior Publication Data

US 2003/0223869 A1 Dec. 4, 2003

(51) Int. Cl.[7] ..... F04D 29/00

(52) U.S. Cl. ..... 416/5; 362/226; 362/147; 362/405

(58) Field of Search ..... 416/5, 7, 244 R; 362/147, 148, 150, 387, 404, 405, 435, 226, 457

(56) References Cited

U.S. PATENT DOCUMENTS 4,300,188 A * 11/1981 Addario ..... 362/485
5,351,174 A * 9/1994 Ewing ..... 362/226
6,322,232 B1 * 11/2001 Oliver ..... 362/147

* cited by examiner

*Primary Examiner*—Edward K. Look
*Assistant Examiner*—Dwayne J. White

(57) ABSTRACT

A do-it-yourself ceiling fan with a ceiling lamp has a ceiling frame and a guide head. A control rod can pull a confining inserting rod backwards so as to compress a spring. Thereby, the confining inserting rod is separated from a ceiling frame. The guide head inserts into an inserting seat of the ceiling frame, thereby, the ceiling fan being conductive to the ceiling lamp. By the resilient force of the spring, the resisting ring of the confining inserting rod restores to the original position to prevent the guide head from falling down. When it is desired to package, transfer or store the ceiling fan, the guide head with the ceiling lamp is pulled out from the ceiling fan. In assembly, it is only necessary to insert the guide head of the ceiling lamp into the ceiling frame of the ceiling fan without needing studs, and other tools.

4 Claims, 7 Drawing Sheets

DO-IT-YOURSELF CEILING FAN WITH CEILING LAMP

FIELD OF THE INVENTION

The present invention relates to ceiling fans, and particularly to a do-it-yourself ceiling fan with a ceiling lamp, which can be detached for transferring, storage and packaging and the user can assemble the present invention easily.

BACKGROUND OF THE INVENTION

The prior art conductive connecting device for connecting a ceiling fan and a ceiling lamp uses studs and nuts to connect the two components. It is not only that the lamp is easily to be collided in assembly, but also the other hand tool (for example, a spanner, an opener, etc. ) is necessary in assembly. Moreover, the friction in assembly will cause the electric wire to expose out so as to induce some dangerous conditions. Therefore, it is unsuitable to be assembled by the user and thus the manufacturers must assembly the wire connecting box and the lamp rod in advance for sale. However, this will increase the cost.

SUMMARY OF THE INVENTION

Accordingly, the primary object of the present invention is to provide a do-it-yourself ceiling fan with a ceiling lamp having a ceiling frame in a switch box of a ceiling fan, and a guide head at a top of a ceiling lamp. The guide head is exactly inserted into the ceiling frame. A center of the ceiling frame has a through hole. A top thereof is vertically extended with a receptacle which is exactly coupled to the through hole at a center of the ceiling frame. Two sides of the ceiling frame have lateral holes. A lower end of the ceiling frame is horizontally extended with a supporting plate and a confining structure is installed above the supporting plate. The confining structure is formed by a hollow cylinder seat, a control rod; a spring; and a confining inserting rod. A buckling block is protruded from a middle section of the control rod. The control rod is locked to a distal end of the confining inserting rod so as to confine the spring to an interior of the cylinder seat and the confining inserting rod is pulled at the same time. A distal end of the cylinder seat is installed with a notch for being inserted by the buckling block of the control rod. A front section of the confining inserting rod is a forked rod for preventing the guide head from falling down. The confining inserting rod has a resisting ring coupling to a distal end of the control rod. The resisting ring exactly resists against the lateral side of the spring. A lower end of the guide head passes through the ceiling lamp in advance. A lateral side of the guide head has lateral wings with respect to the lateral holes and capable of inserting into the lateral holes. The confining inserting rod is installed between the two lateral holes. The confining inserting rod is inserted into the inserting space after the guide head is inserted into the ceiling frame. A plug at a top thereof exactly inserts into the receptacle; and thereby, a user can assemble the ceiling fan with the ceiling lamp by himself or herself for reducing the volume for storing.

The various objects and advantages of the present invention will be more readily understood from the following detailed description when read in conjunction with the appended drawing.

DETAILED DESCRIPTION OF THE PREFERRED EMBODIMENTS

Figure 1:
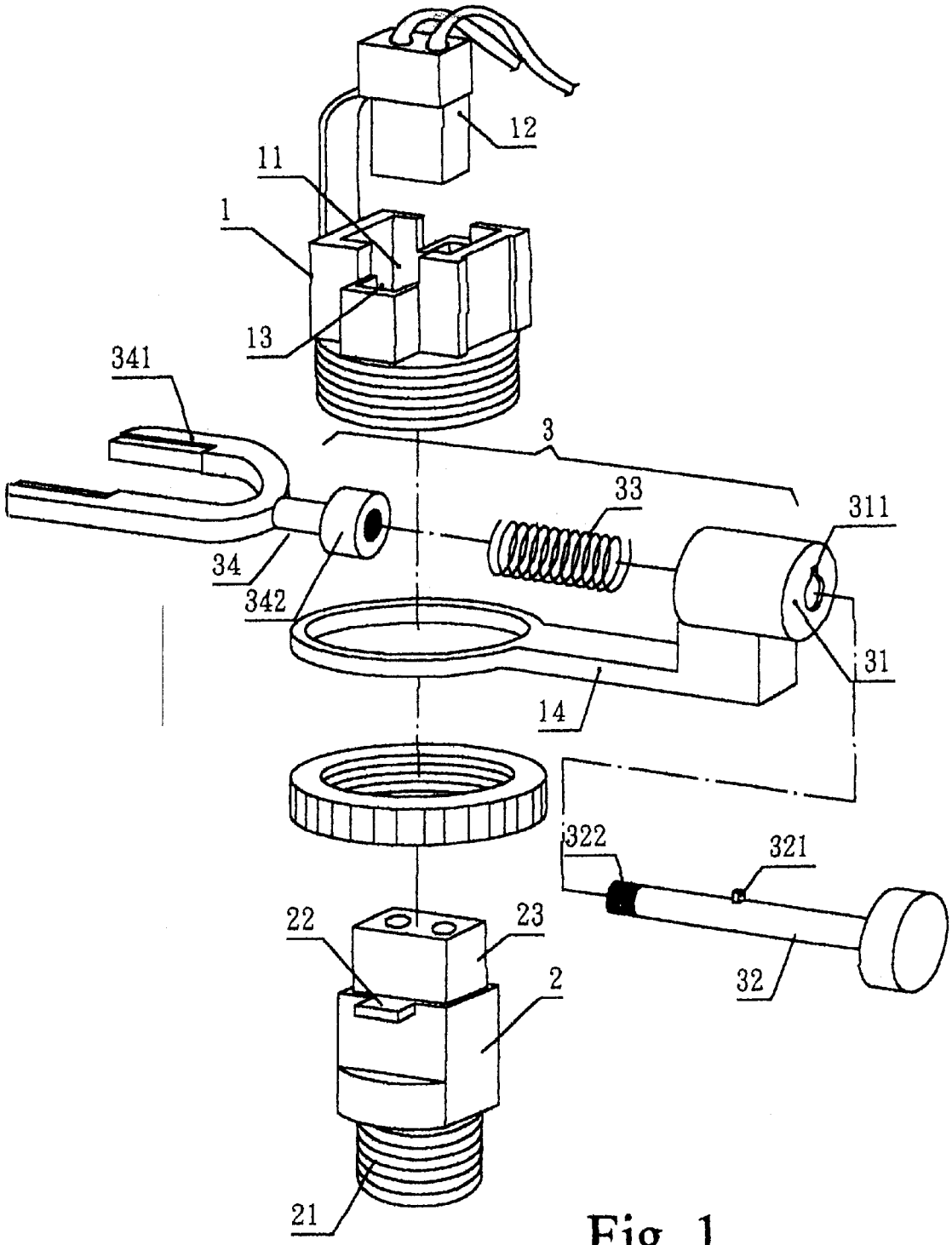
FIG. 1 is an exploded perspective view of the present invention.
Figure 2:
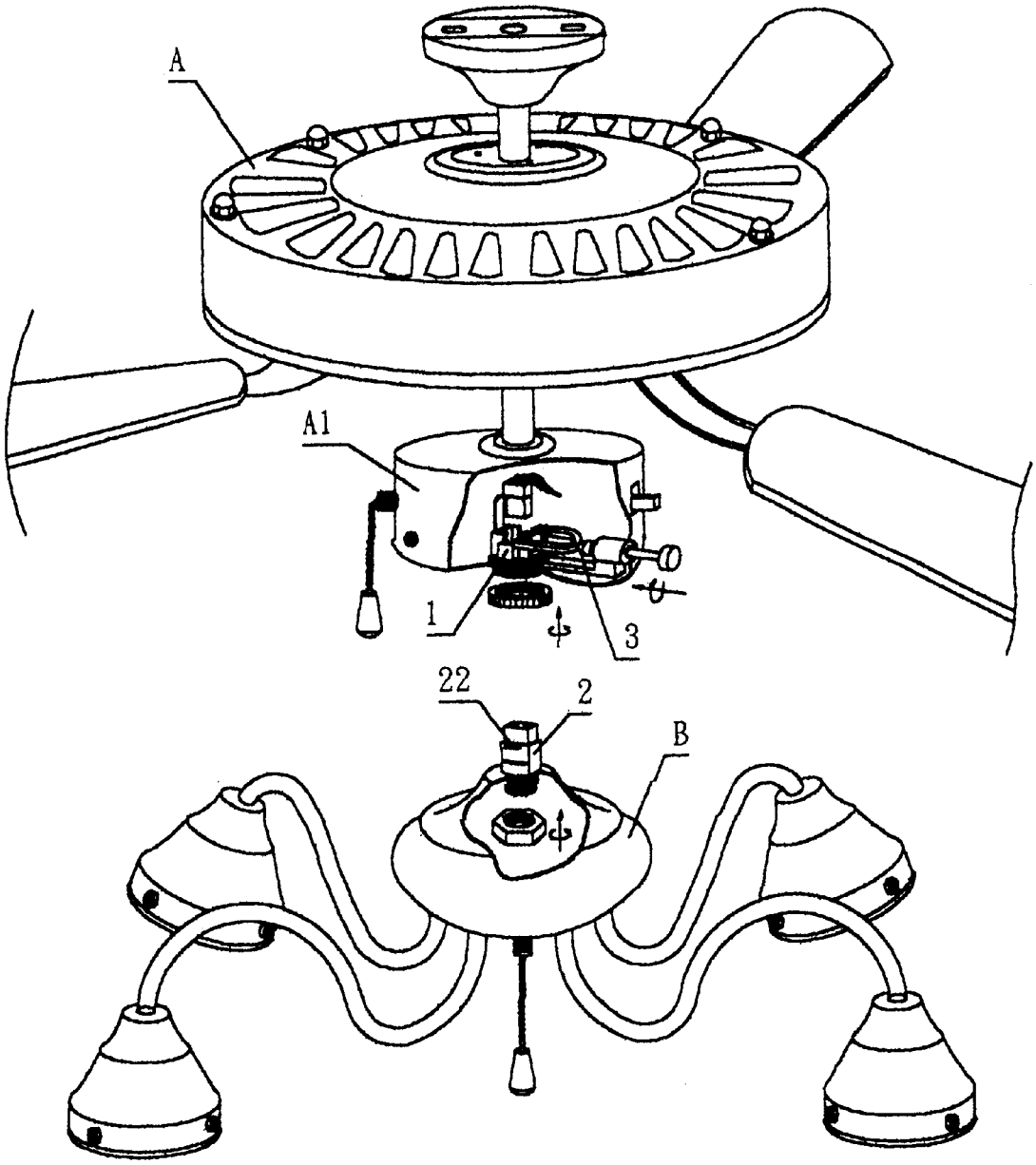
FIG. 2 is an assembled view of the present invention.

Referring to FIGS. 1 and 2, the structure of the present invention is illustrated. The present invention has a ceiling frame 1 in a switch box A1 of a ceiling fan A, and a guide head 2 at a center of a top of a ceiling lamp B. The guide head 2 is exactly inserted into the ceiling frame 1.

A center of the ceiling frame 1 has a through hole 11. A top thereof is vertically extended with a receptacle 12 with an electric wire passing through the receptacle 12. The receptacle 12 is exactly coupled to the through hole 11 at a center of the ceiling frame 1. Two sides of the ceiling frame 1 have lateral holes 13. The through hole 11 communicates the two lateral holes 13. Thereby, the lateral wings 22 of the guide head 2 can be locked into the ceiling frame 1. A lower end of the ceiling frame 1 is horizontally extended with a supporting plate 14 and a confining structure 3 is installed above the supporting plate 14.

The confining structure 3 is formed by a hollow cylinder seat 31 above the supporting plate 14, a control rod 32 passing through the passing through the cylinder seat 31; a spring 33 installed to the control rod 32; a confining inserting rod 34 locked to a front of the control rod 32. A buckling block 321 is protruded from a middle section of the control rod 32. A front end of the control rod 32 has a threaded section 322. The control rod 32 passes through the cylinder seat 31 and the spring 33. Then the control rod 32 is locked to a distal end of the confining inserting rod 34 so as to confine the spring 33 to an interior of the cylinder seat 31 and the confining inserting rod 34 can be pulled at the same time. A distal end of the cylinder seat 31 is installed with a notch 311 for being inserted by the buckling block 321 of the control rod 32. A front section of the confining inserting rod 34 is a forked rod 341 which are extended to two lateral holes 13 at two sides of the ceiling frame 1 and meanwhile resists against the lateral wings 22 of the guide head 2 for preventing the guide head 2 from falling down. The confining inserting rod 34 has a resisting ring 342 coupling to a distal end of the control rod 32. The resisting ring 342 exactly resists against the lateral side of the spring 33. Thereby, when the confining inserting rod 34 pulls backwards with the control rod 32, the resisting ring 342 exactly compresses the spring 33 so that the confining inserting rod 34 is separated from the guide head 2.

A lower end of the guide head 2 has a threaded portion 21. The threaded portion 21 passes through the ceiling lamp B in advance. A nut C serves to lock the top end of the ceiling lamp B. A lateral side of the guide head 2 has lateral wings 22 with respect to the lateral holes 13 and capable of inserting into the lateral holes 13. The confining inserting rod 34 is installed between the two lateral holes 13. The confining inserting rod 34 is inserted into the inserting space S. After the guide head 2 is inserted into the ceiling frame 1, the plug 23 at a top thereof exactly inserts into the receptacle 12.

Figure 3A:
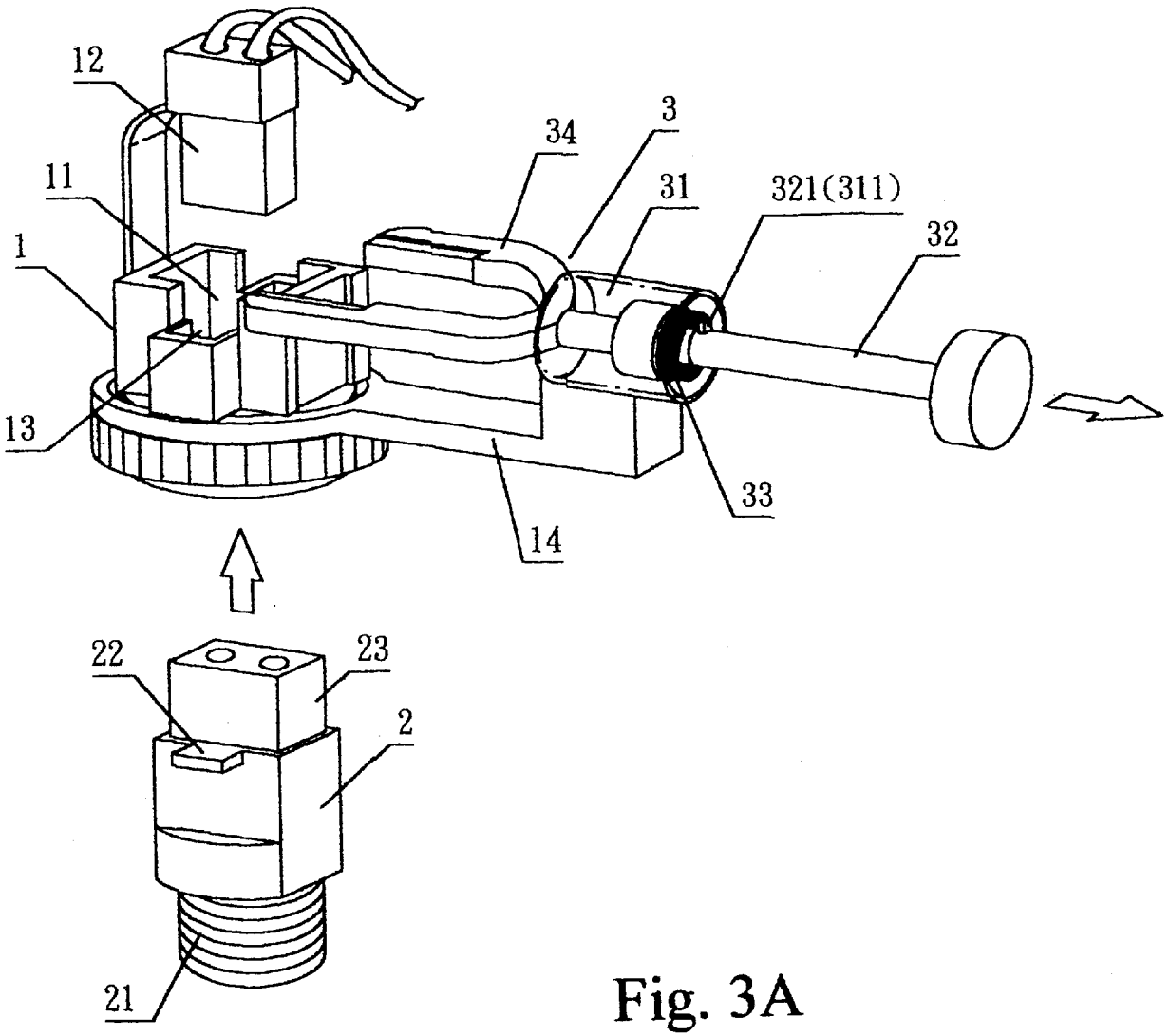
FIG. 3A shows one embodiment of the present invention before the present invention is assembled.
Figure 3B:
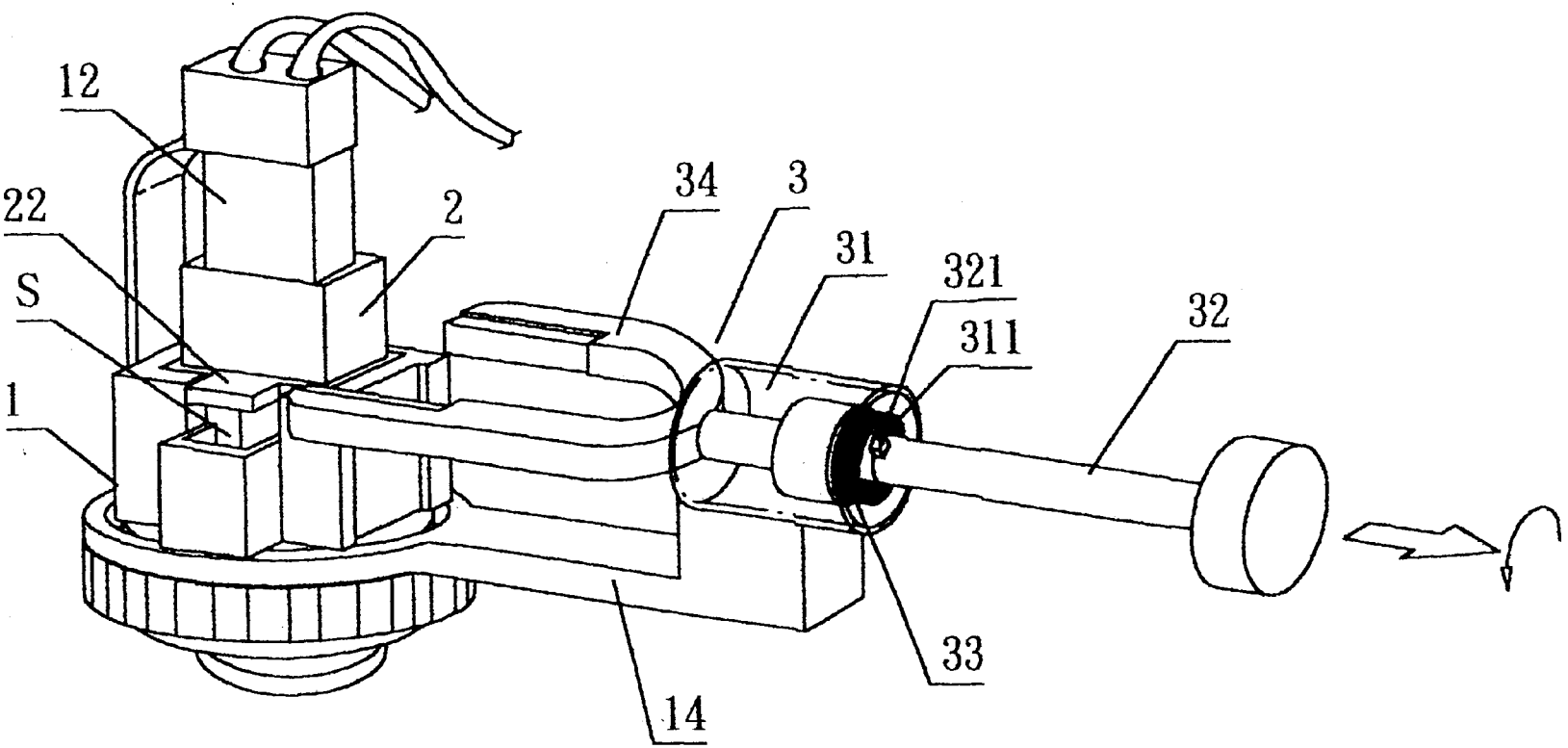
FIG. 3B shows one embodiment of the present invention in that the present invention is being assembled.
Figure 3C:
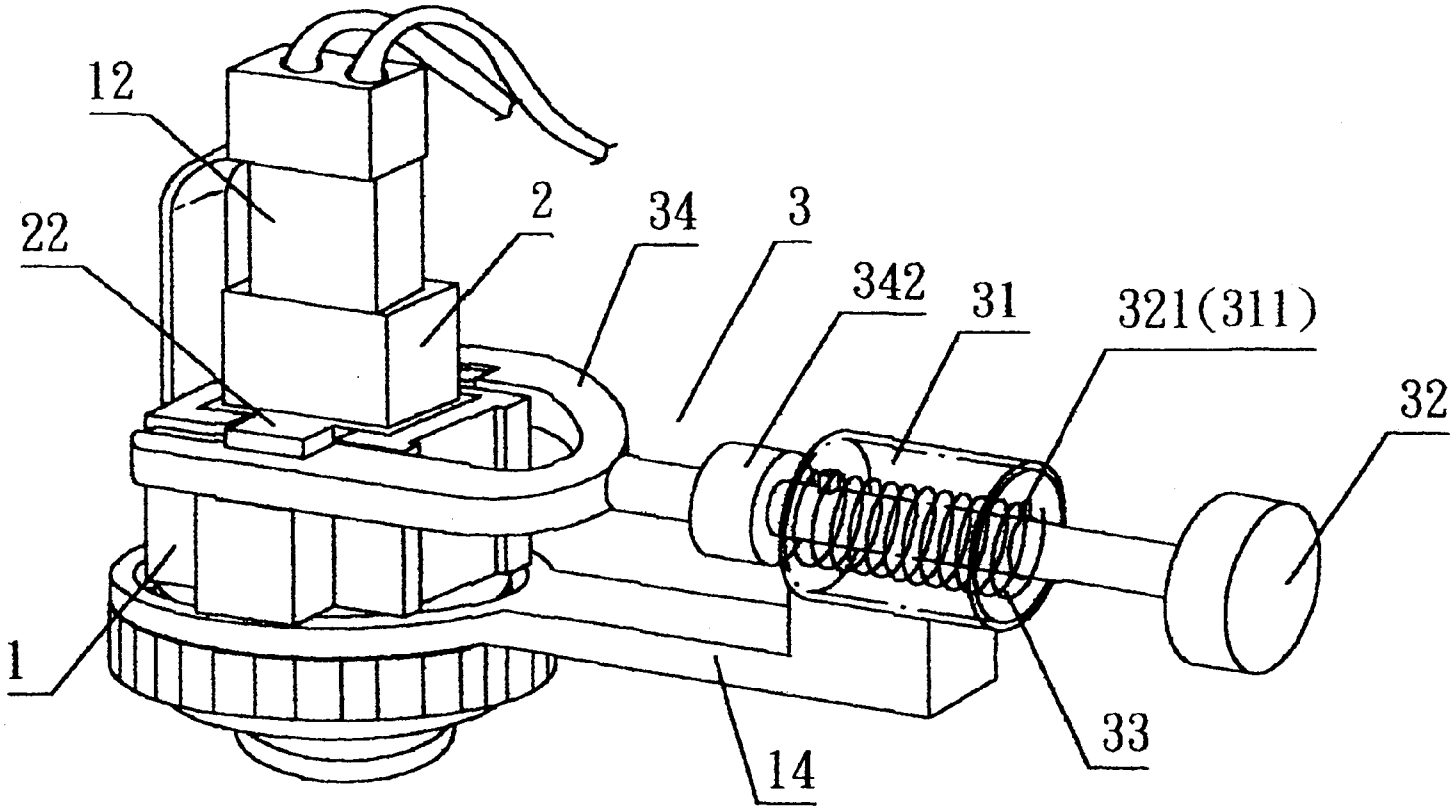
FIG. 3C shows one embodiment of the present invention after the present invention is assembled.

The assembly and operation way of the present invention will be described herein with reference to FIG. 3. In the confining structure 3 firmly secured above the supporting plate 14, the control rod 32 pulls backwards so that the resisting ring 342 of the confining inserting rod 34 properly compresses the spring 33 so that the buckling block 321 of the control rod 32 protrudes out from the notch 311 of the cylinder seat 31 and the control rod 32 rotates, thereby, to be positioned to the distal end of the cylinder seat 31. Then, the control rod 32 pulls the confining inserting rod 34 at the same time so as to separate from the ceiling frame 1 (referring to FIG. 3A). As a result, two hands of the user can support the ceiling lamp B to be assembled with a lower end of the ceiling fan A.

Further, the guide head 2 passes through a lower end of the ceiling frame 1 and then is inserted into the inserting seat 12 of the ceiling frame 1. Thereby, the ceiling fan A and ceiling lamp B are communicated. Then, after the lateral wings 22 of the guide head 2 passes through the lateral holes 13, it retains an inserting space S with the lateral holes 13. Thereby, the confining inserting rod 34 can be inserted therein (referring to FIG. 3B).

When the guide head 2 and ceiling frame 1 are conductive, the control rod 32 is rotated backwards so that the buckling block 321 is coupled to the notch 311 of the cylinder seat 31. Then by the resilient force of the spring 33 to resist against the resisting ring 342 of the confining inserting rod 34 to move back to the original position. Then, the forked rod 341 of the confining inserting rod 34 is exactly inserted into the inserting space S between the lateral holes 13 and the lateral wings 22 of the guide head 2 so as to resist against the lateral wings 22 of the guide head 2 to prevent the guide head 2 from falling down (referring to FIG. 3C).

It is known that by the resisting effect of the confining inserting rod 3, the guide head 2 can be confined in the ceiling frame 1. If it is desired to separate the guide head 2 from the ceiling frame 1, the control rod 32 must pull the resist ring 342 of the confining inserting rod 34 so as to compress the spring 33 properly and thus the confining inserting rod 34 is separated from the ceiling frame 1. Then, the guide head 2 is taken down from the ceiling frame 1.

Figure 4A:
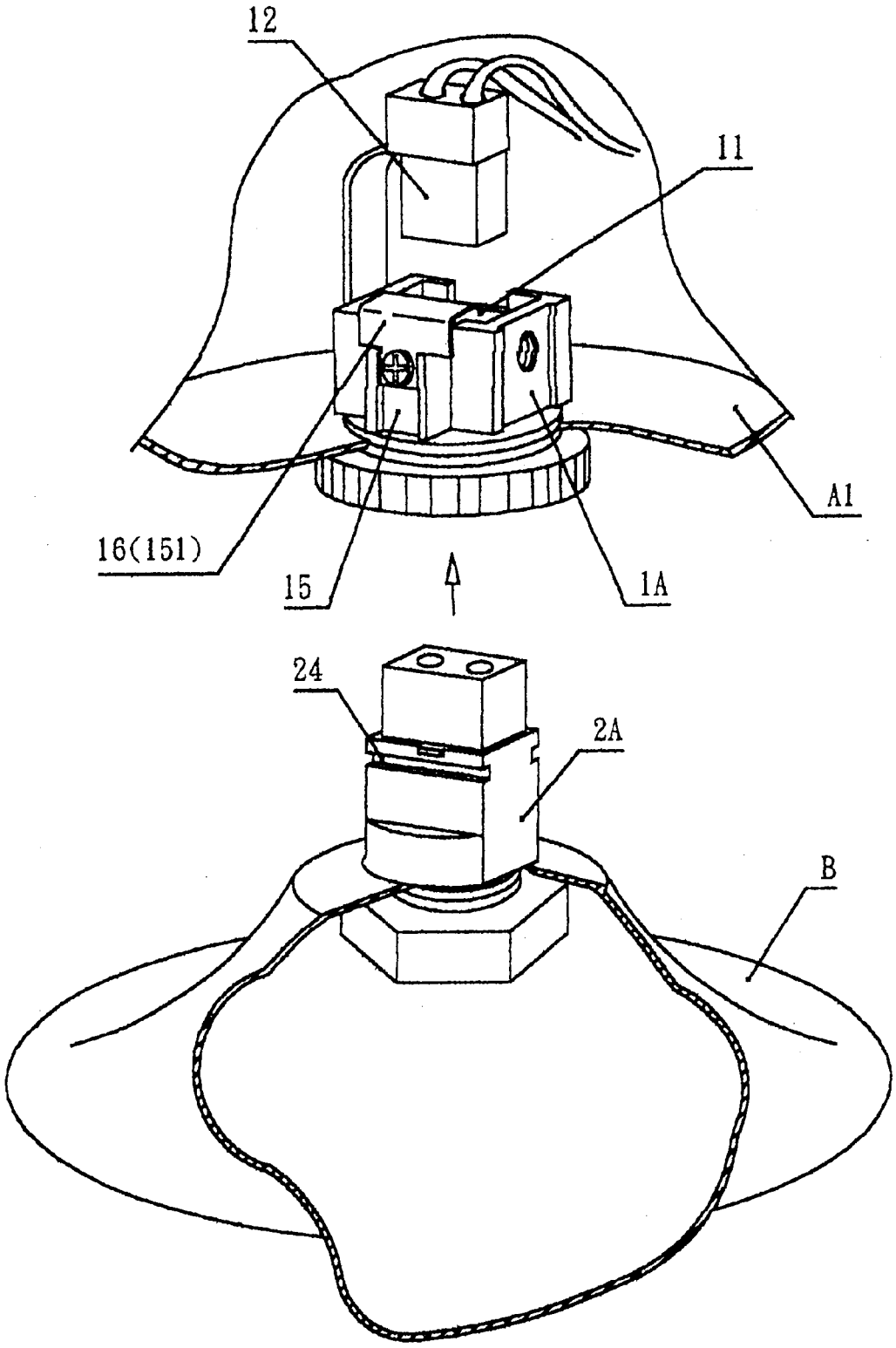
FIG. 4A shows another embodiment of the present invention before the present invention is assembled.
Figure 4B:
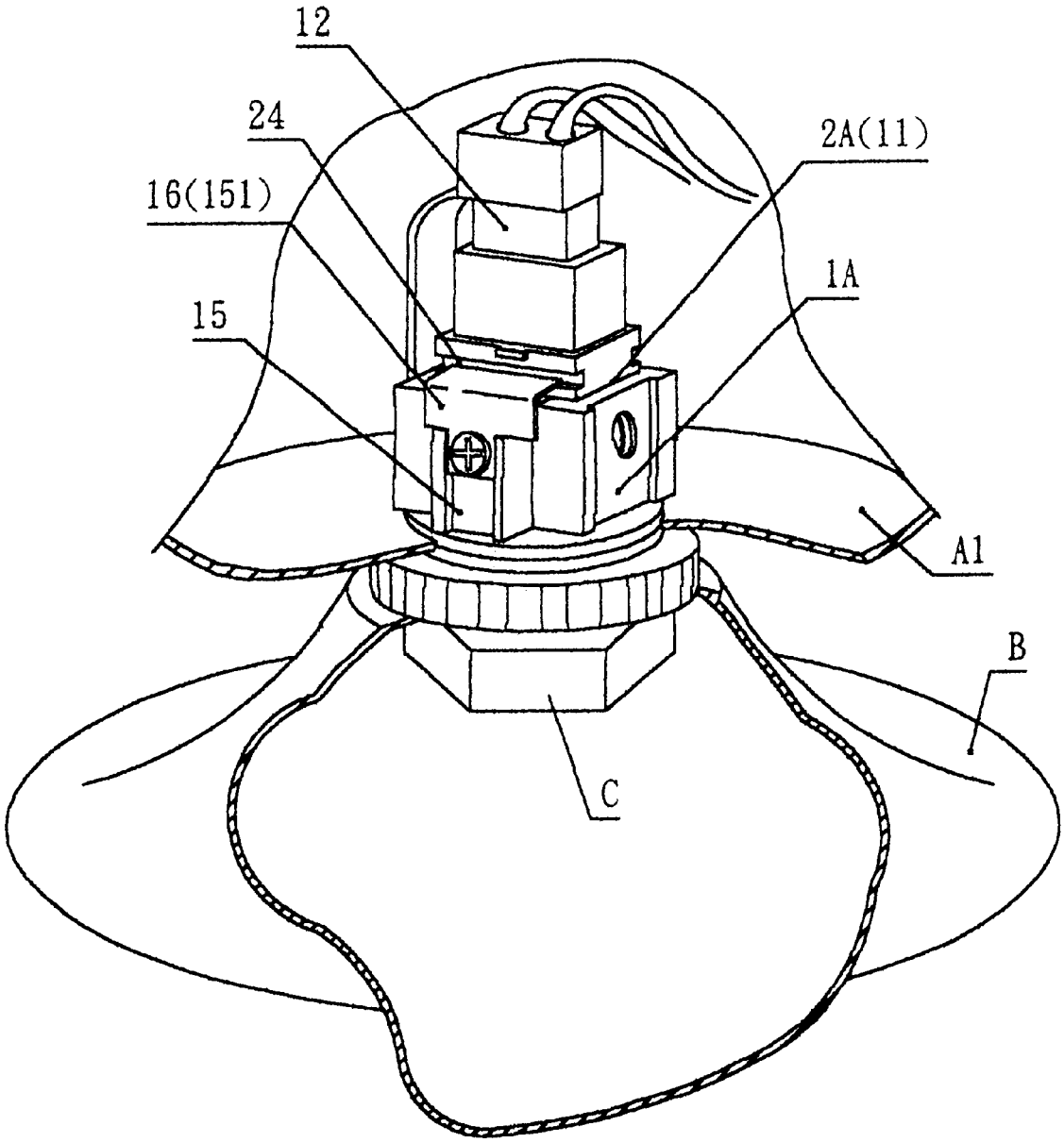
FIG. 4B shows another embodiment of the present invention after the present invention is assembled.

Further referring to FIGS. 4A and 4B, another embodiment of the present invention is illustrated. A center of the ceiling frame 1A has a through hole 11 and a lateral side thereof is extended with a receptacle 12. One lateral side of the ceiling frame 1 is protruded with lateral blocks 15 for being locked by confining pieces. An upper side of each lateral block 15 has inserting hole 151. A lower side of the inserting hole 151 is locked with a confining piece 16 having a protruding portion which exactly inserts into the through hole so that the guide head 2 can be buckled therein. The side of the guide head 2 coupled to the confining piece 16 has an embedding groove 24. After the guide head 2 inserts into a lower end of the ceiling frame 1, the embedding groove 24 of the guide head 2 exactly resists against the confining piece 16 of the ceiling frame 1. As a result, the ceiling fan A and ceiling lamp B are connected as an integral body.

By above mentioned structure, when it is desired to package, transfer or store the ceiling fan, the guide head 2 with the ceiling lamp B is pulled out from the ceiling frame 1 of the ceiling fan A for reducing the space for storage. In assembly, it is only necessary to insert the guide head 2 of the ceiling lamp B into the ceiling frame 1 of the ceiling fan A without needing studs, and other tools. Thereby, the user can assemble the present invention easily.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A do-it-yourself ceiling fan with a ceiling lamp having a ceiling frame in a switch box of a ceiling fan, and a guide head at a top of a ceiling lamp; the guide head being exactly inserted into the ceiling frame; wherein a center of the ceiling frame has a through hole; a top thereof is vertically extended with a receptacle with an electric wire passing through the receptacle; the receptacle is exactly coupled to the through hole at a center of the ceiling frame; two sides of the ceiling frame have lateral holes; the through hole communicates the two lateral holes; a lower end of the ceiling frame is horizontally extended with a supporting plate and a confining structure is installed above the supporting plate;

the confining structure is formed by a hollow cylinder seat above the supporting plate, a control rod passing through the cylinder seat; a spring installed to the control rod; a confining inserting rod locked to a front of the control rod; a buckling block is protruded from a middle section of the control rod; a front end of the control rod has a threaded section; the control rod passes through the cylinder seat and the spring; then the control rod is locked to a distal end of the confining inserting rod so as to confine the spring to an interior of the cylinder seat and the confining inserting rod is pulled at the same time; a distal end of the cylinder seat is installed with a notch for being inserted by the buckling block of the control rod; a front section of the confining inserting rod is a forked rod which are extended to two lateral holes at two sides of the ceiling frame and meanwhile resists against the lateral wings of the guide head for preventing the guide head from falling down; the confining inserting rod has a resisting ring coupled to a distal end of the control rod; the resisting ring exactly resists against the lateral side of the spring; thereby, when the confining inserting rod pulls backwards with the control rod, the resisting ring exactly compresses the spring so that the confining inserting rod is separated from the guide head;

a lower end of the guide head passes through the ceiling lamp in advance; a lateral side of the guide head has lateral wings with respect to the lateral holes and capable of inserting into the lateral holes; the confining inserting rod is installed between the two lateral holes; the confining inserting rod is inserted into the inserting space; after the guide head is inserted into the ceiling frame; a plug at a top thereof exactly inserts into the receptacle; and thereby, a user can assemble the ceiling fan with the ceiling lamp by himself or herself for reducing a storage volume.

2. The do-it-yourself ceiling fan with a ceiling lamp as claimed in claim 1, wherein a buckling block is protruded from a middle section of the control rod; a distal end of the cylinder seat has a notch for being passed through by the buckling block so that the control rod can rotate and is positioned therein.

3. The do-it-yourself ceiling fan with a ceiling lamp as claimed in claim 1, wherein a lower end of the guide head has a threaded portion; the threaded portion passes through the ceiling lamp; a nut serves to lock the top end of the ceiling lamp.

4. The do-it-yourself ceiling fan with a ceiling lamp as claimed in claim 1, wherein a lateral side of the ceiling frame has an inserting hole; a lower side of the inserting hole is locked with a confining piece having a protruding portion which exactly inserts into the through hole so that the guide head is buckled therein; a side of the guide head coupled to the confining piece has an embedding groove; after the guide head inserts into a lower end of the ceiling frame, the embedding groove of the guide head exactly resists against the confining piece of the ceiling frame.

* * * * *